US010274279B2

(12) United States Patent
Lee

(10) Patent No.: US 10,274,279 B2
(45) Date of Patent: Apr. 30, 2019

(54) FIREARM SUPPRESSOR ADAPTER FOR FIREARM RAILS

(71) Applicant: Darryl S. Lee, Fort Myers, FL (US)

(72) Inventor: Darryl S. Lee, Fort Myers, FL (US)

(73) Assignee: DBDROP Inc., Fort Myers, FL (US)

( * ) Notice: Subject to any disclaimer, the term of this patent is extended or adjusted under 35 U.S.C. 154(b) by 0 days.

(21) Appl. No.: 16/184,582

(22) Filed: Nov. 8, 2018

(65) Prior Publication Data

US 2019/0072354 A1 Mar. 7, 2019

Related U.S. Application Data

(63) Continuation of application No. 15/625,542, filed on Jun. 16, 2017, which is a continuation of application No. 15/499,430, filed on Apr. 27, 2017, now Pat. No. 10,066,890, and a continuation of application No. 15/601,528, filed on May 22, 2017, now Pat. No. 9,891,017, application No. 16/184,582, which is a continuation of application No. 15/642,467, filed on Jul. 6, 2017, now Pat. No. 10,190,839, which is a continuation of application No. 15/499,430, filed on Apr. 27, 2017, now Pat. No. 10,066,890, application No. 16/184,582, which is a continuation of application No. 15/790,319, filed on Oct. 23, 2017, which is a continuation of application No. 15/601,528, filed on May 22, 2017, now Pat. No. 9,891,017, application No. 16/184,582, which is a continuation of application No. 15/674,622, filed on Aug. 11, 2017, now Pat. No. 10,161,704, and a continuation of application No. 16/031,483, filed on Jul. 10, 2018, which is a continuation of application No. 15/819,893, filed on Nov. 21, 2017, now Pat. No. 10,048,033, application No. 16/184,582, which is a continuation of application No. 15/912,965, filed on Mar. 6, 2018, which is a continuation of application (Continued)

(51) Int. Cl.
*F41A 21/32* (2006.01)
*F41A 21/44* (2006.01)

(52) U.S. Cl.
CPC ..... *F41A 21/325* (2013.01); *F41A 21/44* (2013.01)

(58) Field of Classification Search
CPC ..... F41A 21/325; F41A 21/30; F41A 21/32
USPC ..... 89/14.4; 181/223; 42/107
See application file for complete search history.

(56) References Cited

U.S. PATENT DOCUMENTS 2,351,037 A 6/1944 Green
2,866,288 A 12/1958 Herter
3,045,379 A 7/1962 Cutts
(Continued)

FOREIGN PATENT DOCUMENTS

WO 2009139803 A2 11/2009

*Primary Examiner* — Samir Abdosh
(74) *Attorney, Agent, or Firm* — Nicholas Pfeifer; Smith & Hopen, P.A.

(57) ABSTRACT

A firearm adapter that can attach to a rail secured to a firearm barrel and can quickly, accurately, securely, and concentrically attach a suppressor or suppressor extension to the firearm barrel even when the firearm barrel includes a muzzle device, such as a flash hider. The adapter is tool-less and attaches a suppressor or other muzzle device to a variety of rail equipped firearms with different geometries while providing strong securement and proper alignment.

20 Claims, 6 Drawing Sheets

Related U.S. Application Data

No. 15/901,219, filed on Feb. 21, 2018, now Pat. No. 10,082,354.

(60) Provisional application No. 62/583,227, filed on Nov. 8, 2017.

(56) References Cited

U.S. PATENT DOCUMENTS

| | | | | |
|---|---|---|---|---|
| 3,710,679 | A | 1/1973 | Werbell, III | |
| 3,797,155 | A | 3/1974 | Smith et al. | |
| 5,685,105 | A * | 11/1997 | Teetzel | F41A 9/62 362/114 |
| 6,973,863 | B1 | 12/2005 | Jones | |
| 7,194,836 | B1 * | 3/2007 | Urban | F41C 27/22 42/106 |
| 8,973,481 | B2 | 3/2015 | Dueck et al. | |
| 2011/0154711 | A1 * | 6/2011 | Dickerson | F41A 21/325 42/107 |
| 2014/0157640 | A1 * | 6/2014 | Whelan | F41C 23/16 42/75.02 |
| 2014/0190345 | A1 * | 7/2014 | Daniel | F41A 21/325 89/193 |
| 2015/0184968 | A1 | 7/2015 | Fischer et al. | |
| 2015/0362276 | A1 * | 12/2015 | Fischer | F41G 11/003 89/14.4 |
| 2017/0307322 | A1 * | 10/2017 | Davis | F41A 21/30 |

* cited by examiner

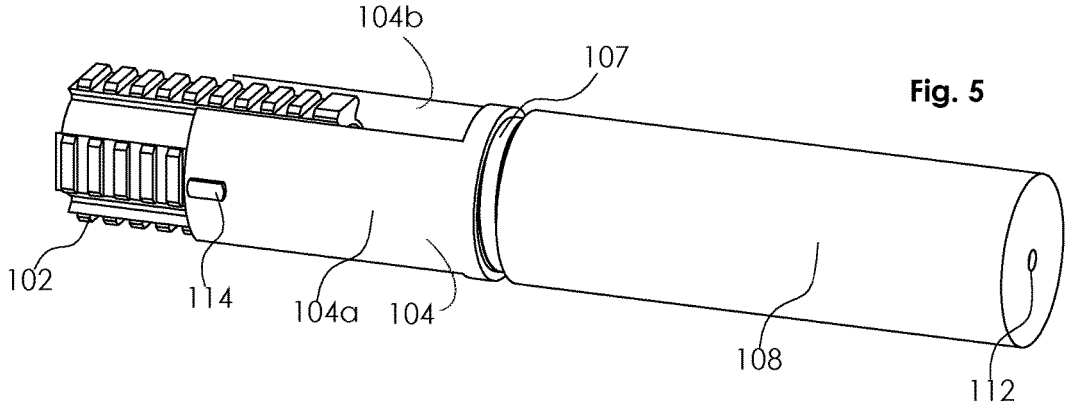
Fig. 5
Fig. 6
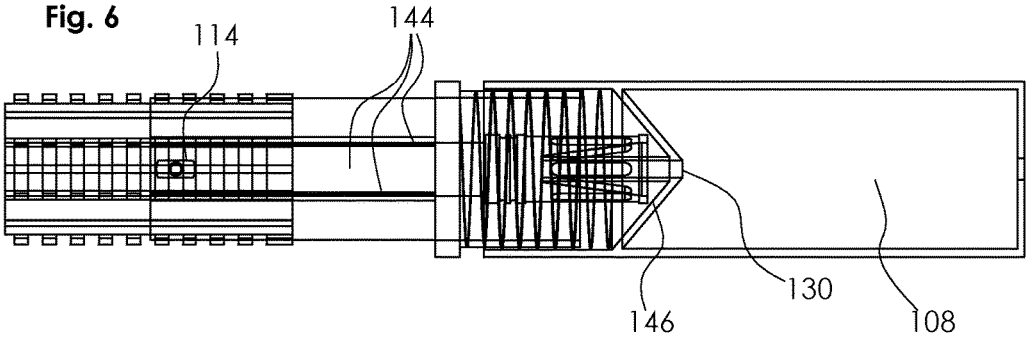
Fig. 7
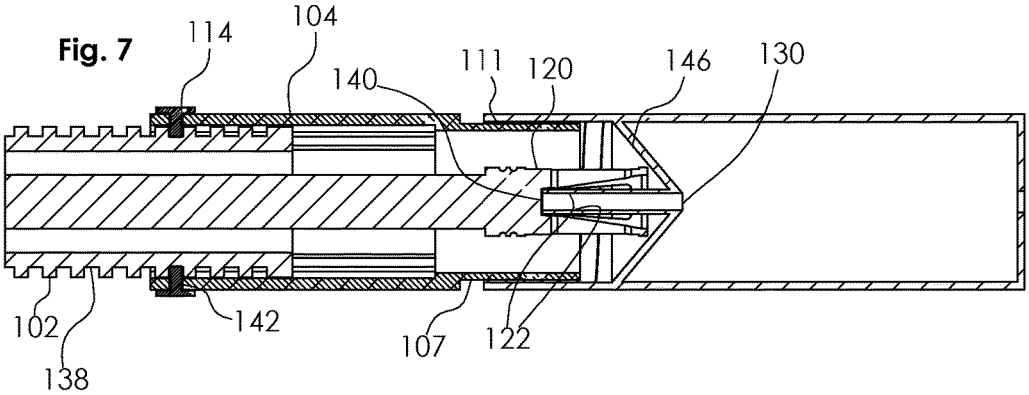
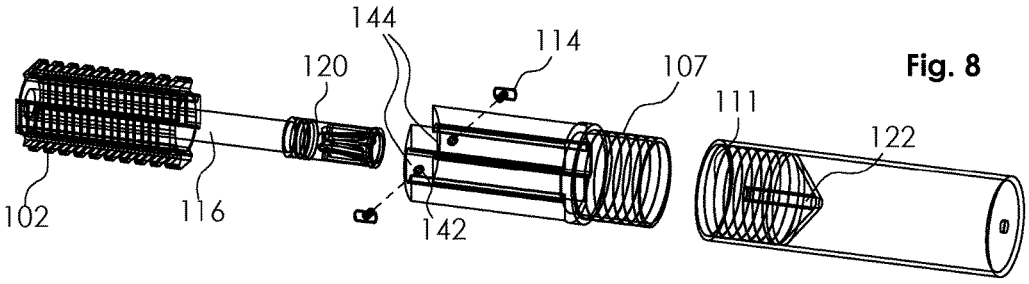
Fig. 8

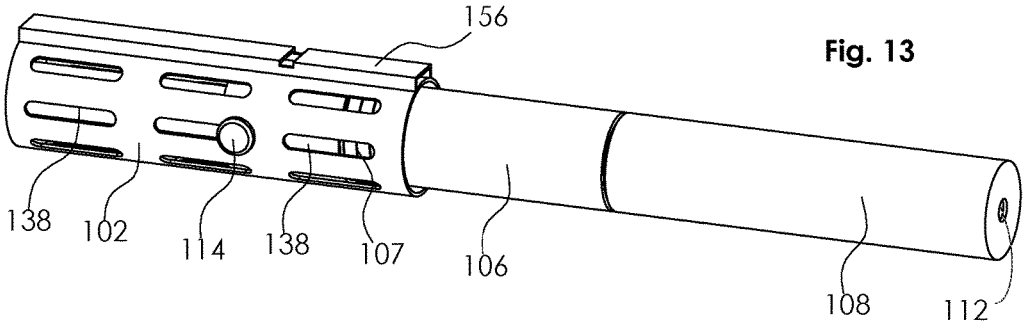
Fig. 13
Fig. 14
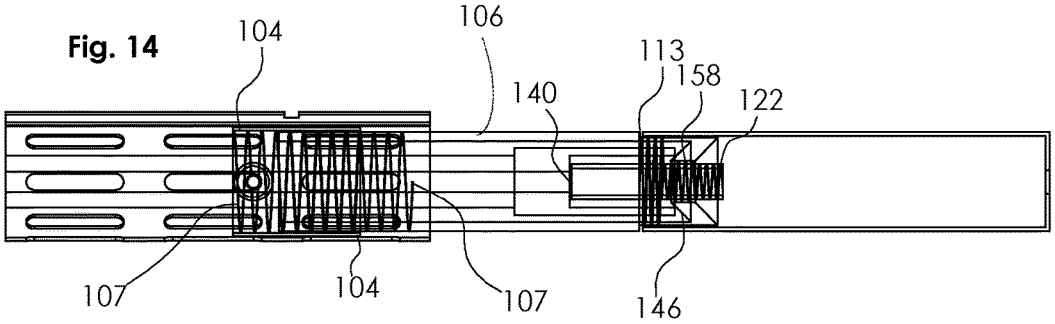
Fig. 15
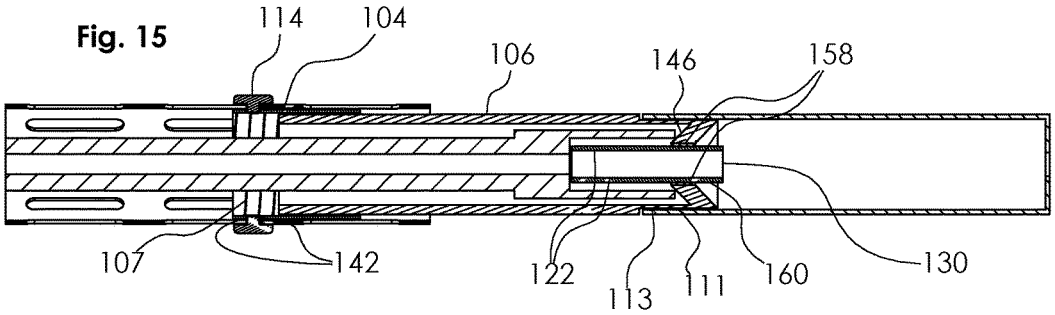
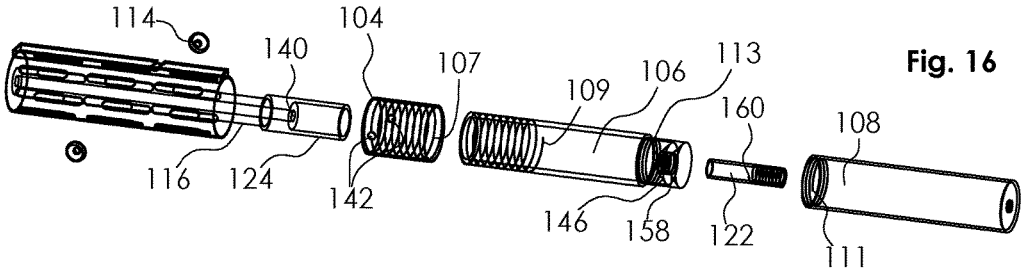
Fig. 16

FIREARM SUPPRESSOR ADAPTER FOR FIREARM RAILS

CROSS-REFERENCE TO RELATED APPLICATIONS

This nonprovisional application claims priority to provisional application No. 62/583,227, entitled "Firearm Accessories," filed Nov. 8, 2017 by the same inventor.

This nonprovisional application is a continuation of and claims priority to nonprovisional application Ser. No. 15/625,542, entitled "Firearm Barrel Fitment Sleeve And Method Of Use," filed Jun. 16, 2017 by the same inventor, which is a continuation of and claims priority to U.S. Non-Provisional application Ser. No. 15/499,430 filed on Apr. 27, 2017, now patent Ser. No. 10/066,890 issued on Sep. 4, 2018 entitled "Firearm Suppressor Adapter," by the same inventor, and is also a continuation of and claims priority to U.S. Non-Provisional application Ser. No. 15/601,528, filed on May 22, 2017 now U.S. Pat. No. 9,891,017 issued on Feb. 13, 2018 entitled "Firearm Suppressor Adapter," by the same inventor.

This nonprovisional application is a continuation of and claims priority to nonprovisional application Ser. No. 15/642,467, entitled "Firearm Barrel Alignment Guide," filed Jul. 6, 2017 by the same inventor, which claims priority to U.S. Non-Provisional application Ser. No. 15/499,430 filed on Apr. 27, 2017, now patent Ser. No. 10/066,890 issued on Sep. 4, 2018 entitled "Firearm Suppressor Adapter," by the same inventor.

This nonprovisional application is a continuation of and claims priority to nonprovisional application Ser. No. 15/790,319, entitled "Firearm Suppressor Adapter," filed Oct. 23, 2017 by the same inventor, which claims priority to U.S. Non-Provisional application Ser. No. 15/601,528, filed on May 22, 2017 now U.S. Pat. No. 9,891,017 issued on Feb. 13, 2018 entitled "Firearm Suppressor Adapter," by the same inventor.

This nonprovisional application is a continuation of and claims priority to nonprovisional application Ser. No. 15/674,622, entitled "Firearm Adapter Configured to Mount to a Firearm Frame," filed Aug. 11, 2017 by the same inventor.

This nonprovisional application is a continuation of and claims priority to nonprovisional application Ser. No. 16/031,483, entitled "Device for Dampening Residual Effects from a Firearm Suppressor," filed Jul. 10, 2018 by the same inventor, which claims priority to U.S. Non-Provisional application Ser. No. 15/819,893 filed on Nov. 21, 2017, now patent Ser. No. 10/048,033 issued on Aug. 14, 2018, entitled "Device for Dampening Residual Effects from a Firearm Suppressor," by the same inventor.

This nonprovisional application is a continuation of and claims priority to nonprovisional application Ser. No. 15/912,965, entitled "Firearm Suppressor Adapter for Barrels Having Obstructions," filed Mar. 6, 2018 by the same inventor, which is a continuation U.S. Non-Provisional application Ser. No. 15/901,219 filed on Feb. 21, 2018 now patent Ser. No. 10/082,354 issued on Sep. 25, 2018, entitled "Firearm Suppressor Adapter for Barrels Having Obstructions," by the same inventor.

BACKGROUND OF THE INVENTION

1. Field of the Invention

This invention relates, generally, to firearms adapters. More specifically, it relates to a universal adapter for firearm suppressors configured to attach to firearm rails.

2. Brief Description of the Prior Art

Most gunfire produce sound that exceeds 140 dB, which can cause immediate and irreparable hearing loss to the gun operator and also significantly contributes to sound pollution. The effects of gun-fire noise are evidenced by the prevalence of hearing damage among veterans, law enforcement, and older individuals that have been around unsuppressed gunfire. Fortunately, suppressors generally reduce the sound of gunfire by 20 to 25 dB on average, reducing the sound to safe levels for the shooter.

For this reason, suppressors are gaining popularity. In some instances, having recognized the damaging effects of unsuppressed gunfire, the military and various law enforcement agencies are making suppressors available to those personnel that are exposed to gunfire. The anticipated resulting reduction in hearing damage from increased suppressor use is not only beneficial to the individual shooter and those around them, but it also provides a societal beneficial by reducing healthcare cost associated with hearing loss.

Up to now, most firearms were manufactured without the thought of or ability to accept a suppressor. Many barrels were made with obstructions, protrusions, rails and profiles that are not conducive to attaching a suppressor to the barrel. In addition, most barrels were made without the necessary cut and thread profile needed to install modern suppressors. Attaching a suppressor to a firearm with a profile that was other than round involved primitive set screw attachment, non-aligned compression or attaching the adapter to the obstruction itself via a single, non-centerline attachment point.

Many modern firearms are also equipped with a rail over the barrel. Rails serve the purpose of shielding the forward hand of the shooter from heat radiating from the barrel during a shooting sequence. In most cases, rails carry a circular profile and have protrusions/attachment surfaces or slots for the attachment of accessories, such as a pistol grip or sight. It is also common among modern firearms to have a factory-installed muzzle device such as a muzzle brake or flash hider attached to a threaded portion of the barrel end. These factory-installed muzzle devices prevent the installation of a suppressor to the firearm without removal of the factory-installed, torque fit muzzle device. The removal process can be difficult and may require a gunsmith.

There are millions of firearms, especially rifles, that include rails and nonthreaded barrels or muzzle devices, such as flash hiders, at the distal end of the barrels. It is currently close to impossible to fit a suppressor to these firearms without removing threading the distal end of the barrel or removing the already attached muzzle device and threading the suppressor onto threads on the distal end of the firearm barrel.

Accordingly, what is needed is a firearm adapter that can attach to a rail secured to a firearm, is easy-to-use, and can quickly, accurately, securely, and concentrically attach a suppressor or suppressor extension to the firearm even when the firearm includes a muzzle device. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a firearm adapter that can attach to a rail secured to a firearm, is easy-to-use, and can quickly, accurately, securely, and concentrically attach a suppressor or suppressor extension to the firearm even when the firearm barrel includes a muzzle device is now met by a new, useful, and nonobvious invention. As will be explained herein, the present invention is extremely adaptable to a variety of firearms with a single device.

In an embodiment, the novel firearm attachment device for securing a muzzle device to a firearm rail includes an adapter adapted to be temporarily secured to the firearm rail. The adapter has a proximal end and a distal end with a length extending therebetween and a longitudinal axis extending parallel to the length. A protrusion extends from the adapter in a radial direction towards the firearm rail and is adapted to engage a slot on the firearm rail when the adapter is secured to the firearm.

The device further includes a muzzle device having a projectile aperture at a distal end. The muzzle device is integrated with or attachable to the distal end of the adapter. In an embodiment, the muzzle device threadedly engages the adapter. In an embodiment the muzzle device is a suppressor having at least on baffle.

The present invention also includes an alignment guide. The alignment guide is concentrically aligned with the adapter and in mechanical communication with at least one of the adapter or muzzle device. Moreover, the alignment guide has a central bore hole sized to permit passage of a projectile, but prevent passage of a firearm muzzle or a pre-existing muzzle device secured to the firearm. In an embodiment, the alignment guide has a frustoconical shape and tapers towards the central bore hole. The frustoconical shape funnels the muzzle or pre-existing muzzle device into axial alignment with the central bore.

The present invention allows the muzzle device to be secured to the firearm by attaching the adapter to the firearm rail without having to remove the pre-existing muzzle device secured to the firearm. An embodiment further includes an extension securable between the adapter and the muzzle device.

An embodiment includes a hollow gas containment sleeve secured to or integrated with the alignment guide. The gas containment sleeve is sized to reside within the pre-existing muzzle device or ensleeve the pre-existing muzzle device. The gas containment sleeve is gas impermeable to prevent discharged gasses from laterally escaping through the pre-existing muzzle device.

In an embodiment, a flange extends radially outwards from a proximal end of the gas containment sleeve and a spring resides between the radial flange and the alignment guide. The spring applies a longitudinally directed force on the alignment guide and the gas containment sleeve.

An embodiment may also include a muzzle housing concentrically aligned and integrated with the alignment guide. The muzzle housing includes a proximal opening sized to receive and ensleeve the pre-existing muzzle device. In an embodiment a spring stop extends radially outwards from the muzzle housing and is located proximate the proximal opening. In addition, a flange extends radially inwards from the muzzle device creating a muzzle housing passage. The muzzle housing passage has an inner diameter generally equal to or larger than an outer diameter of the muzzle housing. A spring resides between the spring stop and the flange. The spring applies a longitudinally directed force on the muzzle device and the muzzle housing.

In an embodiment, the adapter includes at least two protrusions extending inwardly and circumferentially spaced to mirror a circumferential spacing of rail gaps residing between rail attachment surfaces on the rail. Each protrusion includes a length in a circumferential direction with respect to the adapter. The length is equal to or less than one of the rail gaps residing between the rail attachment surfaces, such that each protrusion will not contact the rail attachment surfaces when the protrusions are longitudinally aligned with the rail gaps. Each protrusion also has a width that extends in the longitudinal direction of adapter. The width is sized to fit within the slot on the firearm rail.

In an embodiment, the adapter includes internally located, longitudinally extending channels circumferentially spaced and sized to receive circumferentially spaced rail attachment surfaces on the rail. The channels thereby prevent rotation of the adapter with respect to the rail when the rail attachment surfaces reside within the channels. In an embodiment, the protrusion passes through a protrusion aperture in a lateral surface of the adapter when engaging the rail slot.

An embodiment further comprises at least two diametrically opposed rail engagement tabs proximate the proximal end of the adapter, wherein each tab is established by two longitudinally extending, circumferentially spaced slots and each tab includes the protrusion located proximate a proximal end and extending radially outwards away from the longitudinal axis to engage laterally located rail slots. In an embodiment, the adapter has an outer diameter that is less than an inner diameter of the firearm rail, thereby permitting the adapter to be inserted within the rail.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

FIG. 16 BRIEF DESCRIPTION OF THE DRAWINGS

For a fuller understanding of the invention, reference should be made to the following detailed description, taken in connection with the accompanying drawings, in which:

FIG. 5 is a perspective view of an embodiment of the present invention secured to a rail on a firearm barrel.

FIG. 6 is a wireframe elevation view of the embodiment in FIG. 5.

FIG. 7 is a sectional view of FIG. 6.

FIG. 8 is a disassembled wireframe view of an embodiment of the present invention.

FIG. 13 is a perspective view of an embodiment of an embodiment of the present invention secured to a firearm rail.

FIG. 14 is a wireframe view of an embodiment of the present invention highlighting the internal mechanisms of the adapter.

FIG. 15 is a sectional view of FIG. 14.

FIG. 16 is a disassembled wireframe view of an embodiment of the present invention highlighting the internal mechanisms of the adapter.

Figure 17:
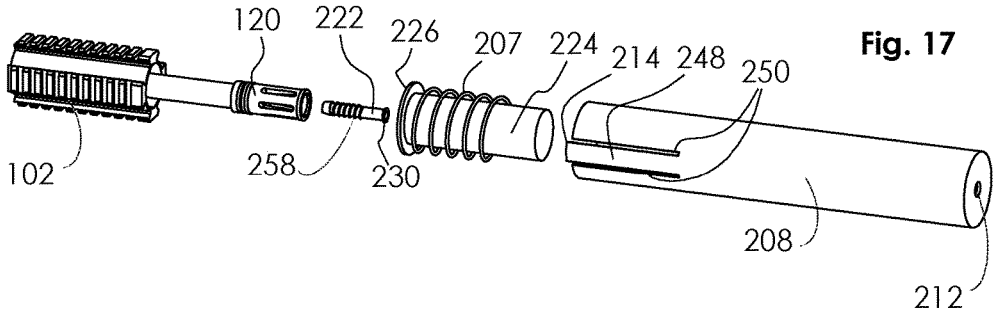
FIG. 17 is a disassembled view of an embodiment of the present invention.
Figure 18:
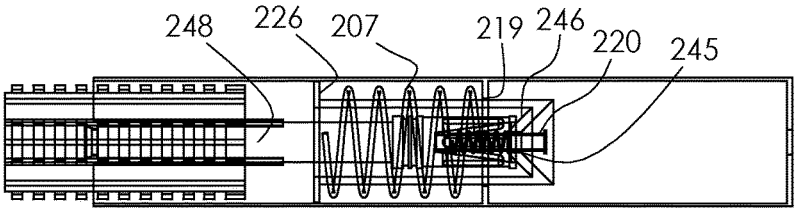

FIG. 18 wireframe view of the embodiment in FIG. 17 secured to a rail on a firearm barrel.

Figure 19:
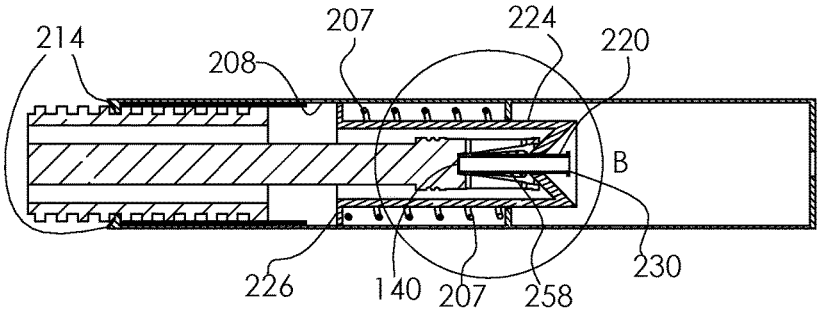

FIG. 19 is a sectional view of FIG. 18.

Figure 20:
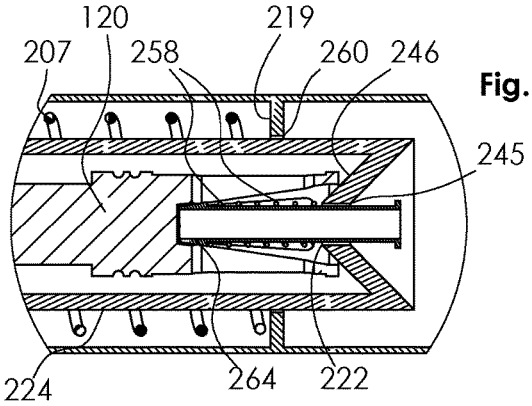

FIG. 20 is a close-up view of the mechanisms captured in circle B shown in FIG. 19.

Figure 21:
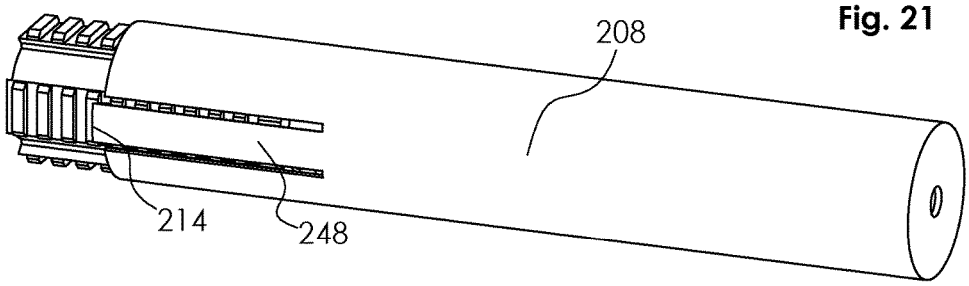

FIG. 21 is a perspective view of an embodiment of the present invention secured to a rail on a firearm barrel.

Figure 11:
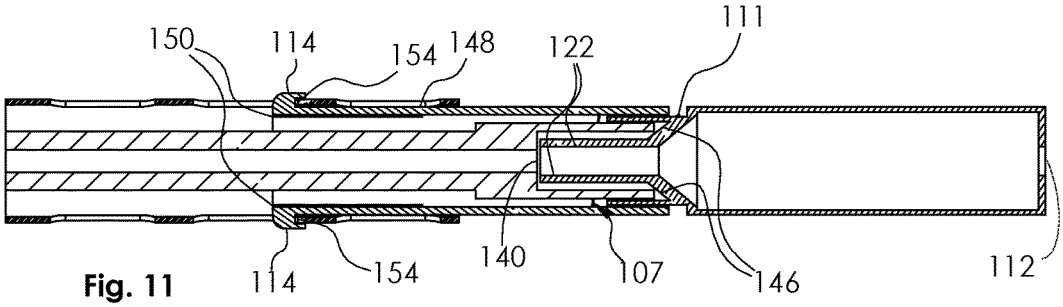
FIG. 11 is a sectional view of FIG. 10.
Figure 12:
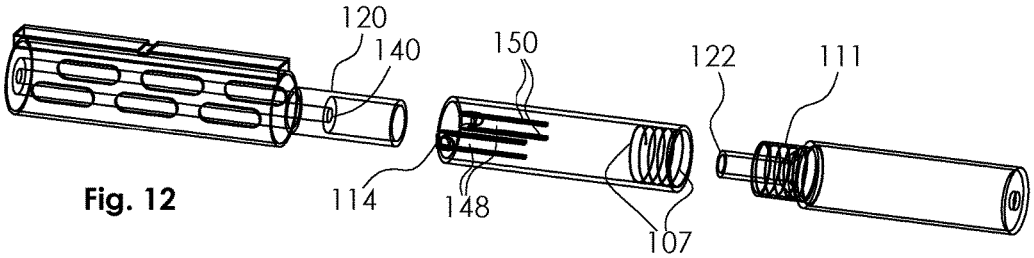
FIG. 12 is a disassembled wireframe view of an embodiment of the present invention.
Figure 22:
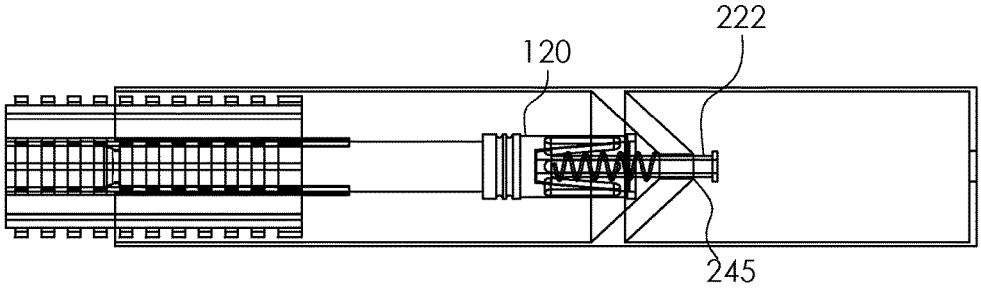

FIG. 22 is a wireframe view of an embodiment of the device depicted in FIG. 11.

Figure 23:
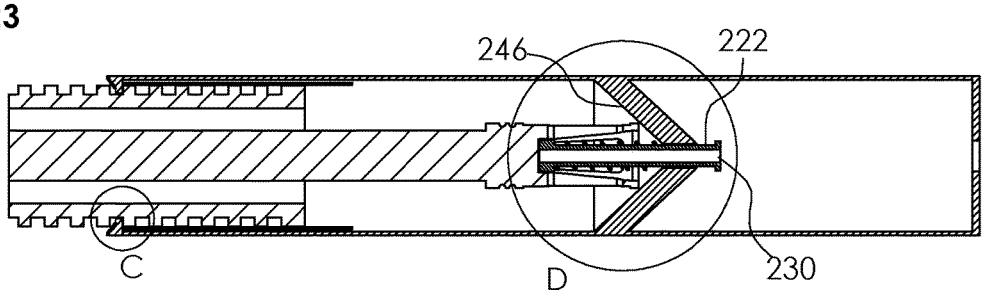

FIG. 23 is a sectional view of FIG. 21.

Figure 24:
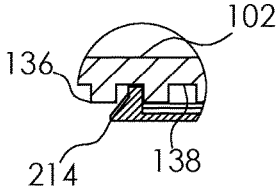

FIG. 24 is a close-up view of circle C shown in FIG. 23.

Figure 25:
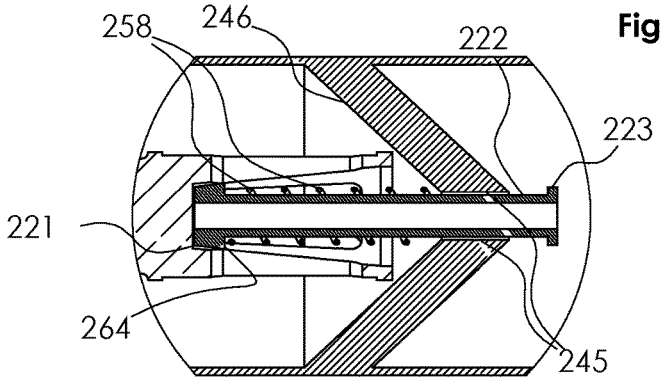

FIG. 25 is a close-up view of circle D shown in FIG. 23.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used herein, the term "muzzle device" is a device that can be added to the distal end of a firearm barrel, including, but not limited to a flash can, flash hider, bird cage, muzzle brake, compensator, blast shield, and simulated (non-functional) suppressor. A suppressor falls within the grouping of muzzle devices, but the term "suppressor" is not intended to include other muzzle devices such as those listed above.

The present invention is an attachment device for a securing a suppressor to a firearm rail for easily attaching and detaching an additional muzzle device, e.g. suppressor, to firearms having a rail and, in some cases, a pre-existing muzzle device. As will be explained in greater detail below, the present invention is adapted to overcome the need to detach any pre-existing/in-use muzzle devices prior to installing a suppressor or secondary muzzle device. This is accomplished by extending around or over the in-use muzzle device and attaching to a firearm rail. Moreover, proper securement and centerline alignment is easily achieved as the adapter and suppressor are attached to the firearm. Removal is also quick and easy for fast day-to-day installation or attachment to different firearms.

The ability of the present invention to attach to a variety of firearms reduces the costs associated with manufacturing, packaging, labeling, and stocking because a single adapter of the present invention can replace thousands of different suppressor and rail adapters. Moreover, the present invention allows a suppressor to be attached to firearms previously incapable of such an attachment.

Referring now to FIGS. 1-5, an embodiment of the firearm attachment device is designed to attach to rail 102. The device includes adapter 104 having a proximal end, a distal end and a hollow body extending therebetween. The body includes an outer surface and an internal surface creating a receiving space. The internal surface has a diameter greater than the outermost diameter of rail 102, thereby allowing adapter 104 to receive rail 102 within the receiving space.

Figure 1:
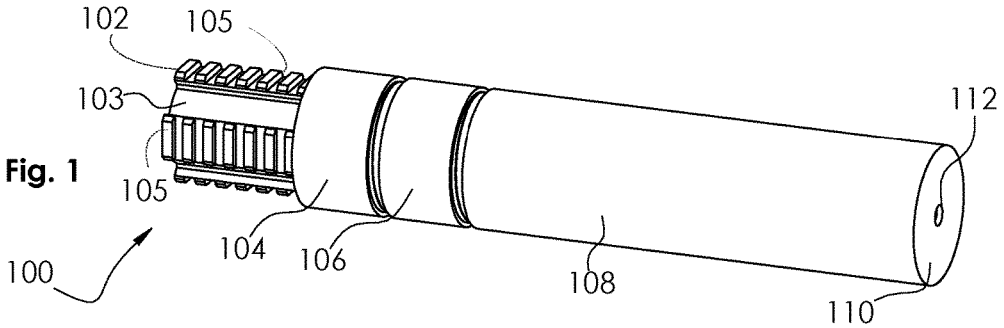
FIG. 1 is a perspective view of an embodiment of the present invention secured to a rail on a firearm barrel.
Figure 2:
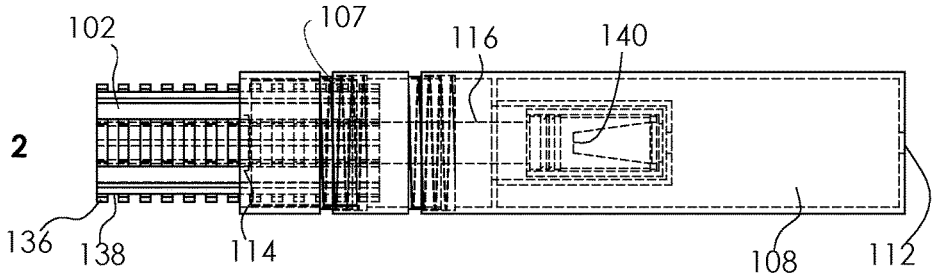
FIG. 2 is a wireframe side view of an embodiment of the present invention highlighting the internal mechanisms of the adapter.
Figure 3:
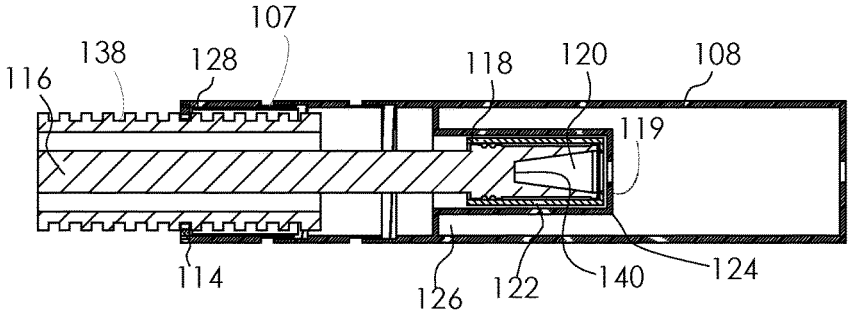
FIG. 3 is a sectional view of FIG. 2.
Figure 4:
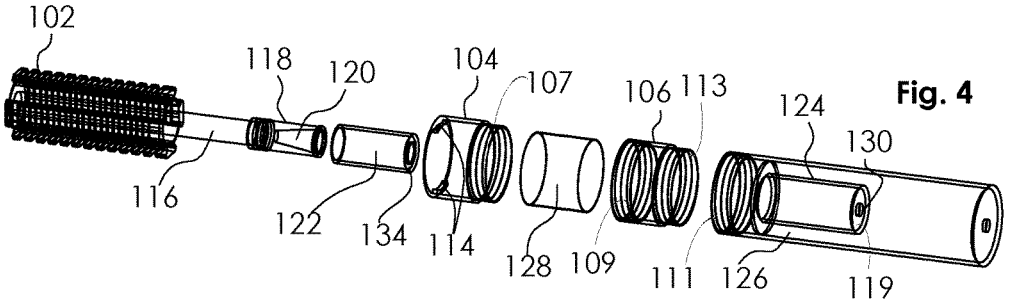
FIG. 4 is a disassembled wireframe view of an embodiment of the present invention.
Figure 9:
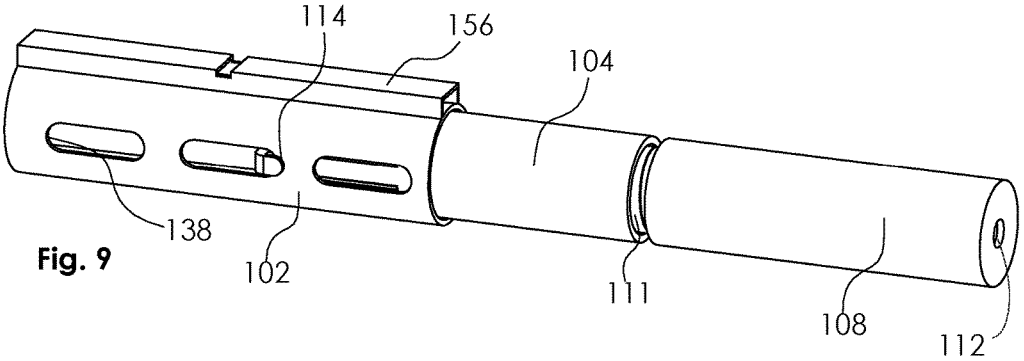
FIG. 9 is a perspective view of an embodiment of an embodiment of the present invention secured to a firearm rail.
Figure 10:
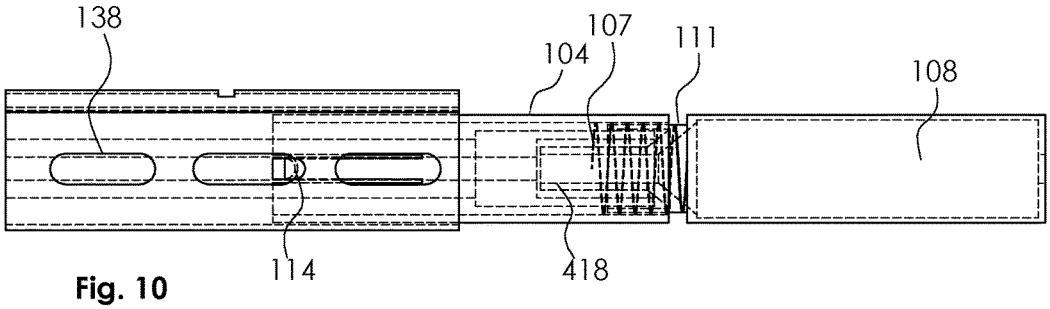
FIG. 10 is a FIG. 6 is a wireframe elevation view of the embodiment in FIG. 9.

The proximal end of adapter 104 includes at least two rail engagement protrusions 114. In the depicted embodiment, protrusions 114 extend from the internal surface of adapter 104 towards the longitudinal axis of adapter 104, i.e. protrusions 114 have an inward extent. The inward extent of protrusions 114 is greater than the difference between the radius of the internal surface of adapter 104 and the outermost radius of rail 102, thereby ensuring that protrusions 114 can penetrate the lateral rail channels/slots 138 as most clearly depicted in FIGS. 2-3. Protrusions 114 further have a width that extends in the longitudinal direction of adapter 104 and likewise the longitudinal axis of barrel 116. The width of protrusions 114 is sized to fit between the rail attachment slot 138 as depicted in FIGS. 2-3.

Protrusions 114 have a length in a lateral or circumferential direction with respect to adapter 104. The length is equal to or less than rail gap 103 residing between rail attachment surfaces 105. Moreover, protrusions 114 are circumferentially spaced to mirror the circumferential spacing of rail gaps 103 about rail 102. As such, protrusions 114 will not contact rail 102 when adapter 104 is rotated about its longitudinal axis to align protrusions 114 with rail gap 103. In said orientation, adapter 104 can translate along the length of rail 102 in a longitudinal direction. At a preferred location along the length of trail 102, adapter 104 can be rotated to bring protrusions 114 into lateral alignment with attachment surfaces 105 and in longitudinal alignment with rail attachment slot 138 as depicted in FIG. 3 to secure adapter 104 to rail 102.

Adapter 104 further includes threads 107 located at its distal end. Threads 107 are adapted to engage threads 109 on extension 106 or threads 111 on suppressor 108. Threads 107 are shown on the external surface of adapter 104, but may be located on the internal surface. Similarly, threads 109 and 111 are shown on internal surfaces, but may reside on external surfaces to engage threads 107 if threads 107 are located on the internal surface of adapter 104. In an embodiment, adapter 104 may engage suppressor 108 or extension 106 using a fastening method other than threads. For example, suppressor 108 or extension 106 may use a cam locking fastener to clamp around adapter 104. In addition, adapter 104 and extension 106 may remain secured to rail 102 even when the suppressor is not in use.

An embodiment includes protective sleeve 128. Protective sleeve 128 is intended to reside inside the adapter 104 to protect rail 102 from damage during installation and use. As depicted in FIG. 3, protective sleeve 128 resides distally from protrusions 114 to avoid interference between protrusions 114 and rail attachment slot 138.

An embodiment of the present invention includes extension 106 having a first set of threads 109 on the proximal end and a second set of threads 113 on the distal end. Proximal threads 109 are similar to threads 111 on suppressor 108 and distal threads 113 are similar to threads 107 on adapter 104. As a result, the extension allows for additional suppressor volume and allows the present invention to work with any firearm regardless of the distance between rail 102 and the muzzle end of the firearm.

As previously explained, suppressor 108 includes threads 111 adapted to engage threads 107 or threads 113. Suppressor 108 further includes projectile aperture 112 disposed in the distal end of suppressor 108. Suppressor 108 can extend around and beyond the firearm muzzle and any muzzle device 120 to engage threads 107 on adapter 104.

An embodiment of suppressor 108 includes muzzle housing 124. Muzzle housing 124 includes a proximal opening sized to receive a muzzle of a firearm and/or muzzle device, such as flash hider 120. Muzzle housing 124 further includes projectile aperture 130 in distal end wall 119 (also known as an alignment guide) through which the projectile can pass. Projectile aperture 130 is concentrically aligned with aperture 112 in distal end of suppressor 108. An embodiment of muzzle housing 124 includes alignment guide 119 being tapered rather than simply being perpendicular to the longitudinal axis as depicted. A tapered alignment guide 119 serves as a funnel for axially aligning bore 140 with aperture 130.

Alignment guide 119 provides a stop for suppressor 108 when suppressor 108 is threadedly tightened to adapter 104 or extension 106. Once alignment guide 119 contacts the muzzle end, adapter 104 is pulled distally as suppressor 108 is continually threadedly tightened to adapter 104. As a result, the connection between protrusion 114 and lateral rail slot 138 securely tightens adapter 104 in place and in turn secures suppressor 108 to the firearm.

As depicted, an embodiment of suppressor 108 includes suppressor extension cavity 126 which extends proximally beyond the distal end of muzzle housing 124. Suppressor extension cavity 126 increases the volume of suppressor 108 thereby increasing its effectiveness.

In an embodiment, the opening on the proximal end of muzzle housing 124 is sized to receive a muzzle device surrounded by gas containment sleeve 122. Most muzzle devices include opening in their lateral surface allowing gas to exit the lateral surface of the muzzle device. Gas containment sleeve 122 is intended to prevent this by ensleeving muzzle device 120. Thus, gas containment sleeve 122 forces discharged gas to pass into the suppressor where the gas is better handled to suppress the firearm.

Gas containment sleeve 122 may come in various sizes/thicknesses to ensure that muzzle device 120 and surrounding containment sleeve 122 securely fit within muzzle housing 124 and force bore 140 in muzzle device 120 to axially align with projectile aperture 130. Moreover, containment sleeve 122 is made of a material adapted to withstand the temperatures associated with discharging gasses and containment sleeve 122 may further be comprised of a compressible material to aid in the secure press/compression fit of muzzle device 120 and containment sleeve 122 within muzzle housing 124. An embodiment of containment sleeve 122 may include 134 retention flange 134. Retention flange 134 ensures that containment sleeve 122 catches the muzzle of muzzle device 120 and prevents containment sleeve 122 from sliding in proximal direction during use or when initially being inserted into muzzle housing 124.

Referring now to FIGS. 5-8, an embodiment of adapter 104 has a body and proximal end separated into longitudinally extending arms 104*a*, 104*b*. Like the embodiment shown in FIGS. 1-4, adapter 104 in FIGS. 5-8 includes threads 107 at a distal end. Threads 107 are adapted to engage suppressor 108 or extension 106.

Arms 104*a*, 104*b* are designed to slide around the sides of rail 102 making way for upper and lower barrel obstructions. While two arms are depicted, it is contemplated that more or less arms may be used. At least two arms are diametrically opposed and include an inwardly extending protrusion as depicted FIGS. 1-4. Alternatively, or in addition to, arms 104*a*, 104*b* include fastener aperture 142 to receive protrusions 114, which are depicted as threaded bolts in FIGS. 5-8. Bolts 114, or any other similar fastener, threadedly engage, or simply pass through aperture 142 into lateral rail slots 138 as most clearly depicted in FIG. 7.

In an embodiment, arms 104*a*, 104*b* include internally located open channels 144 extending in a longitudinal direction. Channels 144 are sized and shaped to receive side rails on rail 102. Once channels 144 receive the side rails, the orientation of adapter 104 is secured with respect to rail 102. An embodiment of adapter 104 may be a hollow cylindrical shape like the one depicted in FIGS. 1-4, but also include channels 144. Channels 144 could be arranged about the internal surface of adapter 104 to receive one or more of the attachment surfaces 105 of rail 102.

FIGS. 5-8 also depict a variation of suppressor 108 having an integrated containment sleeve 122 and a tapered alignment guide 146. Containment sleeve 122 as depicted best in FIGS. 6-7 has an outer diameter that is smaller than the internal diameter of muzzle device 120. Accordingly, containment sleeve 122 slides into muzzle device 120 and forces discharged gas to pass into the suppressor. An embodiment, however, may include containment sleeve 122 being sized to reside on the external surface of muzzle device 120.

Containment sleeve 122 is also concentrically aligned with projectile aperture 112. The receipt of containment sleeve 122 into muzzle device 120 therefore helps ensure that bore 140 of muzzle device 120 is concentrically aligned with projectile aperture 112 in suppressor 108. Alignment guides 146 also contributes to the axial alignment of bore 140 with projectile aperture 112. Alignment guide 146 is preferably generally frustoconically shaped, being tapered in a distal direction thereby causing muzzle device 120 to axially align with the longitudinal axis of suppressor 108 when an axial force causes alignment guide 146 to funnel muzzle device 120 into axial alignment. Alignment guide 146, however, may be tapered in the proximal direction to funnel muzzle device 120.

FIGS. 9-12 depict another variation of adapter 104. The embodiment of adapter 104 depicted in FIGS. 9-12 includes threads 107 located at the distal end of adapter 104 for engaging suppressor 108 or extension 106. The proximal end includes two diametrically opposed rail engagement tabs 148. Each tab 148 is established by two longitudinally extending, circumferentially spaced slots 150. While two tabs are depicted, an embodiment may include more than two tabs to engage rail 102.

Each tab 148 is adapted to flex in a radial direction and includes protrusion 114 adapted to engage a rail on a firearm. The exemplary rail 102 depicted in FIGS. 9-12 includes lateral slots 138. Protrusions 114 are sized and designed to engage lateral slots 138. These types of rails often include an upper rail 156 and therefore, adapter 104 is sized to reside between the internal surface of rail 102 and the outer surface of firearm barrel 116. As a result, protrusions 114 extend outwardly away from the longitudinal axis of adapter 104 to engage slots 138. The proximal ends of protrusions 114 are rounded to reduce friction and ensure that tabs 148 flex towards the longitudinal axis as adapter 104 passes into rail 102. Once protrusions 114 radially align with slots 114, tabs 148 flex back into their position of repose and protrusions 114 extend laterally through slots 138. The embodiment of protrusions 114 as depicted are hook-like to securely receive a distal edge of slot 138 when adapter 104 is pulled distally with respect to rail 102.

An embodiment of adapter 104 is adapted to have an internal diameter greater than the outer diameter of rail 102 and thus receive rail 102. Said embodiment works with rails that do not include upper rail section 156 or adapter 104 may include a cutout to receive upper rail section 156. This embodiment would also include protrusions 114 extending inwardly towards the longitudinal axis of adapter 104.

FIGS. 9-12 also depict a modified embodiment of suppressor 108. The adapter depicted in FIGS. 9-12 however may be used with other suppressors and the suppressor depicted in FIGS. 9-12 may be used with other adapters.

Suppressor 108 depicted in FIGS. 9-12 includes externally located threads 111 adapted to engage threads 107 on adapter 104. In an embodiment, threads 111 may be internal and threads 107 may be external. Once adapter 104 is secured to rail 102, the threaded engagement of suppressor 108 and adapter 104 pulls suppressor 108 towards the muzzle end of muzzle device 120. Tapered alignment guide 146 contacts the muzzle end of muzzle device 120 as suppressor 108 is pulled towards muzzle device 120 and alignment guide 146 funnels muzzle device 120 into axial alignment with suppressor 108. In addition, the contact of the muzzle end of muzzle device 120 with alignment guide 146 secures the connection of adapter 104 to rail 102.

As depicted, alignment guide 146 is frustoconical and tapers in a proximal direction. However, alignment guide 146 may taper is a distal direction and achieve the same results of funneling muzzle device 120 into axial alignment with suppressor 108. Certain embodiments may also a non-tapered alignment guide.

Suppressor 108 also includes gas containment sleeve 122 extending distally within muzzle device 120. As such, containment sleeve 122 has an outer diameter that is smaller than the internal diameter of muzzle device 120. Accordingly, containment sleeve 122 slides into muzzle device 120 and forces discharged gas to pass into the suppressor. An embodiment, however, may include containment sleeve 122 being sized to reside on the external surface of muzzle device 120. Containment sleeve 122 is also concentrically aligned with projectile aperture 112. The receipt of containment sleeve 122 into muzzle device 120 therefore helps ensure that bore 140 of muzzle device 120 is concentrically aligned with projectile aperture 112 in suppressor 108.

Referring now to FIGS. 13-16, the exemplary embodiment includes a variation of adapter 104 sized to reside between firearm barrel 116 and rail 102. The depicted adapter 104 employs threaded fasteners 114 which pass through rail slots 138 to engage threaded fastener receipt 142 in adapter 104. Fastener 114 may be any fastener known to a person of ordinary skill in the art so long as the fastener includes a head that at least partially resides on the external surface of rail 102 to restrict the longitudinal movement of adapter 104 with respect to rail 102. While depicted configuration shows adapter 104 having a size to reside within rail 102, in an embodiment, adapter 104 may be sized to reside on the external surface of rail 102.

Because adapter 104 resides within rail 102, threads 107 are located on the internal surface of adapter 104 and are adapted to engage extension 106 via external threads 109, or in some embodiments, engage threads 111 on suppressor 108. When employing extension 106, the proximally located threads 111 on suppressor 108 engage the distally located threads 113 on extension 106.

In the depicted embodiment, extension 106 includes alignment guide 146 which is tapered in a proximal direction. Alternatively, alignment guide 146 can be a part of suppressor 108 and/or be tapered distally rather than proximally. As previously explained alignment guide 146 helps axially align suppressor 108 with muzzle device 120.

Alignment guide 146 further includes threads 158 adapted to engage threads 160 on gas containment sleeve 122. This threaded arrangement allows gas containment sleeve 122 to be perfectly distanced for various muzzle devices. As previously explained, gas containment sleeve 122 is designed to withstand the high temperatures associated with the discharge of a firearm and force the discharged gas into suppressor 108.

Referring now to FIGS. 17-25, an embodiment of the present invention employs springs rather than threads to create the longitudinal force to pull against rail 102 and thus secure suppressor 208 to rail 102. As depicted suppressor 208 includes two integrated rail engagement tabs 248 diametrically opposed from each other. Each tab 248 is established by two longitudinally extending, circumferentially spaced slots 250. While two tabs are depicted, an embodiment may include more than two tabs to engage rail 102.

Each tab 248 is adapted to flex in a radial direction and includes protrusion 214 adapted to engage rail 102 on a firearm. The depicted exemplary rail 102 includes lateral slots 138 in which protrusions 214 are sized and designed to engage. As best depicted in FIG. 24, the proximal ends of protrusions 214 are tapered to reduce friction and ensure that tabs 248 flex away the longitudinal axis as suppressor 208 passes around rail 202 when moving in a proximal direction. The distal ends of protrusions 214 include a right angle to prevent protrusions 214 from exiting slots 138, without user assistance, when pulled in a distal direction. Once protrusions 214 radially align with slots 138, tabs 248 flex back into their position of repose and protrusions 214 retain suppressor 208 at its longitudinal location relative to rail 102.

Referring to FIGS. 17-19, an embodiment of suppressor 208 includes radial flange 219 extending inwardly towards the longitudinal axis of suppressor 208. Radial flange 219 includes an inner diameter slightly larger than the outer diameter of muzzle housing 224. In an embodiment, flange 219 may be comprised of several flanges creating a discontinuous radial flange. In an embodiment, muzzle housing 224 is slidably integrated with suppressor 208.

Muzzle housing 224 includes a spring stop 226 located at or near its proximal end and spring 207 resides between spring stop 226 and radial flange 219. Spring 207 applies a spring force onto suppressor 208 through contact with radial flange 219, which in turn pulls protrusions 214 into secure contact with one of rail ridges 136 located distally from rail slot 138.

The distal end of muzzle housing 224 includes a distally tapering frustoconical shaped alignment guide 246 leading to bore 245. The tapered shape of alignment guide 246 forces the muzzle end of muzzle device 220 into axial alignment with projectile aperture 212. In an embodiment, alignment guide 246 may be tapered in a distal direction, opposite of that shown in the exemplary FIGS. 18-20, or may be non-tapered.

The exemplary embodiment shown in FIGS. 17-25 also includes a gas containment sleeve 222 that is slidably received through bore 245. Gas containment sleeve performs the same functions as previously explained in other embodiments. The depicted embodiment of containment sleeve 222 further includes a proximally located flange 264 acting as a spring stop for spring 258. Alignment guide 246 provides the distally located spring stop for spring 258. Spring 258 ensures that containment sleeve 222 is fully inserted in muzzle device 120 to better contain discharged gases.

Referring now to FIGS. 22-25, an embodiment of suppressor 208 may be used without muzzle housing 224. In this embodiment, alignment guide 246 ensures the axial alignment of the muzzle device 120 with suppressor 208. Moreover, containment sleeve 222, in conjunction with spring 258, ensures that suppressor 208, and in turn protrusions 214, are pushed distally away from rail 102 to secure suppressor 208 to rail 102 as previously explained.

Regardless of the embodiment of the adapter or suppressor, each of the adapters and suppressors are configured to work with the various embodiment. Moreover, each adapter and suppressor are adapted to align the barrel of a firearm with the suppressor.

Furthermore, while some of the depicted embodiments illustrate suppressors having integrated muzzle housings, alignment guides, and/or rail engagement tabs, these features may be integrated into adapters and/or extension instead of the suppressors. In such instances, traditional suppressors lacking these features can be fastened/attached to the extensions and/or adapters. Alternatively, the embodiments having extensions can be modified such that the components of the extensions are integrated into the suppressors or the adapters.

The various embodiments in FIGS. 1-16 include a suppressor or suppressor extension threadedly engaging the adapter. However, the adapter, suppressor, and/or suppressor extension may include a different fastening method than threads. For example, the engagement of the various components may be accomplished using cam locks, threaded fasteners, clamps, sockets and latches, detents and detent orifices, snap buckles, pawls and ratchets, rivets, dowels, and rotational locking mechanisms.

As depicted in each exemplary image, the adapters are generally cylindrical in shape, but may have any shape that allows the adapter to be secured to the firearm rail while also axially aligning with the barrel of the firearm.

Each of the embodiments of the adapter may be used with a fitment insert, protective sleeve or gas containment sleeve. The fitment inserts are designed to occupy excessive radial gaps between the adapters and rails. The fitment inserts provide an inexpensive and highly variable means for fitting a single size adapter to most firearm rails without requiring a multitude of different diameter adapters.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all the generic and specific features of the invention herein described, and all statements of the scope of the invention that, as a matter of language, might be said to fall therebetween.

Glossary of Claim Terms

Muzzle device: is a device that can be added to the distal end of a firearm barrel, including, but not limited to a flash can, flash hider, bird cage, muzzle brake, compensator, blast shield, and simulated (non-functional) suppressor.

Protrusion: is something that protrudes.

Rail Attachment Surfaces: are the surface of the rail that extend outwardly in a radial direction.

Slot: is an aperture or groove/channel in a firearm rail.

Suppressor: is a muzzle device having baffles to suppress the sound of a firearm when discharged.

What is claimed is:

1. A firearm attachment device for securing a muzzle device to a firearm rail, comprising:

an adapter adapted to be temporarily secured to the firearm rail, the adapter including:

a proximal end and a distal end with a hollow body extending therebetween, the hollow body having a central longitudinal axis parallel to an extent of a barrel of the firearm;

a protrusion, the protrusion extending in a radial direction towards the firearm rail and adapted to engage a slot on the firearm rail when the adapter is secured to the firearm and thereby prevent movement of the adapter with respect to the firearm rail in a longitudinal direction;

the muzzle device having a projectile aperture at a distal end, the muzzle device integrated with or attachable to the distal end of the adapter;

an alignment guide concentrically aligned with the adapter and in mechanical communication with at least one of the adapter or muzzle device, the alignment guide having a central bore hole sized to permit passage of a projectile, but prevent passage of a firearm muzzle or a pre-existing muzzle device secured to the firearm;

whereby the muzzle device can be secured to the firearm by attaching the adapter to the firearm rail without having to remove the pre-existing muzzle device secured to the firearm.

2. The firearm attachment device of claim 1, further including a hollow gas containment sleeve secured to or integrated with the alignment guide, the gas containment sleeve sized to reside within the pre-existing muzzle device or ensleeve the pre-existing muzzle device, the gas containment sleeve being gas impermeable to prevent discharged gasses from laterally escaping through the pre-existing muzzle device.

3. The firearm attachment device of claim 2, further including:

a flange extending radially outwards from a proximal end of the gas containment sleeve; and a spring residing between the radial flange and the alignment guide, the spring applying a longitudinally directed force on the alignment guide and the gas containment sleeve.

4. The firearm attachment device of claim 1, further including a muzzle housing concentrically aligned and integrated with the alignment guide and includes a proximal opening sized to receive and ensleeve the pre-existing muzzle device.

5. The firearm attachment device of claim 4, further including:

a spring stop extending radially outwards from the muzzle housing and being located proximate the proximal opening;

a flange extending radially inwards from the muzzle device creating a muzzle housing passage, muzzle housing passage having an inner diameter generally equal to or larger than an outer diameter of the muzzle housing; and a spring residing between the spring stop and the flange, the spring applying a longitudinally directed force on the muzzle device and the muzzle housing.

6. The firearm attachment device attachment device of claim 1, wherein the muzzle device is a suppressor.

7. The firearm attachment device of claim 1, wherein the alignment guide has a frustoconical shape and tapers towards the central bore hole, the frustoconical shape thereby funneling the muzzle or pre-existing muzzle device into axial alignment with the central bore.

8. The firearm attachment device of claim 1, further including an extension securable between the adapter and the muzzle device.

9. The firearm attachment device of claim 1, wherein the adapter includes at least two protrusions extending inwardly and circumferentially spaced to mirror a circumferential spacing of rail gaps residing between rail attachment surfaces on the rail, each protrusion including:

a length in a circumferential direction with respect to the adapter, the length being equal to or less than one of the rail gaps residing between the rail attachment surfaces, such that each protrusion will not contact the rail attachment surfaces when the protrusions are longitudinally aligned with the rail gaps; and a width that extends in a longitudinal direction of adapter, the width being sized to fit within the slot on the firearm rail.

10. The firearm attachment device of claim 1, wherein the adapter includes internally located, longitudinally extending channels circumferentially spaced and sized to receive circumferentially spaced rail attachment surfaces on the rail, the channels thereby preventing rotation of the adapter with respect to the rail when the rail attachment surfaces reside within the channels.

11. The firearm attachment device of claim 1, wherein the protrusion passes through a protrusion aperture in a lateral surface of the adapter when engaging the rail slot.

12. The firearm attachment device of claim 1, further comprising at least two diametrically opposed rail engagement tabs proximate the proximal end of the adapter, wherein each tab is established by two longitudinally extending, circumferentially spaced slots and each tab includes the protrusion located proximate a proximal end and extending radially outwards away from the central longitudinal axis of the adapter to engage laterally located rail slots.

13. The firearm attachment device of claim 1, wherein the adapter threadedly engages the muzzle device.

14. The firearm attachment device of claim 1, wherein the adapter has an outer diameter that is less than an inner diameter of the firearm rail, thereby permitting the adapter to be inserted within the rail.

15. A firearm attachment device for a securing muzzle device to a firearm rail, comprising:

an adapter adapted to be temporarily secured to the firearm rail, the adapter including:

a proximal end and a distal end with a hollow body extending therebetween, the hollow body having a central longitudinal axis parallel to an extent of a barrel of the firearm;

a protrusion, the protrusion extending in a radial direction towards the firearm rail and adapted to engage a slot on the firearm rail when the adapter is secured to the firearm and thereby prevent movement of the adapter with respect to the firearm rail in a longitudinal direction;

the muzzle device having a projectile aperture at a distal end of the muzzle device, the muzzle device integrated with or attachable to the distal end of the adapter;

an alignment guide concentrically aligned with the adapter and in mechanical communication with at least one of the adapter or the muzzle device, the alignment guide having a central bore hole sized to permit passage of a projectile, but prevent passage of a pre-existing muzzle device secured to the firearm;

a gas containment sleeve attachable to or integrated with the alignment guide, the gas containment sleeve sized to reside within the pre-existing muzzle device or ensleeve the pre-existing muzzle device, the gas containment sleeve being gas impermeable to prevent discharged gasses from laterally escaping through the pre-existing muzzle device;

whereby the muzzle device can be secured to the firearm by attaching the adapter to the firearm rail without having to remove the pre-existing muzzle device secured to the firearm.

16. The firearm attachment device of claim 15, further including:

a radial flange extending radially outwards from a proximal end of the gas containment sleeve; and a spring residing between the radial flange and the alignment guide, the spring applying a longitudinally directed force on the alignment guide and the gas containment sleeve.

17. The firearm attachment device of claim 15, further including a muzzle housing concentrically aligned and integrated with the alignment guide and includes a proximal opening sized to receive and ensleeve the pre-existing muzzle device.

18. The firearm attachment device of claim 17, further including:

a spring stop extending radially outwards from the muzzle housing and being located proximate the proximal opening;

a flange extending radially inwards from the muzzle device creating a muzzle housing passage, muzzle housing passage having an inner diameter generally equal to or larger than an outer diameter of the muzzle housing; and a spring residing between the spring stop and the flange, the spring applying a longitudinally directed force on the muzzle device and the muzzle housing.

19. The firearm attachment device attachment device of claim 15, wherein the muzzle device is a suppressor.

20. A firearm attachment device for a securing a suppressor to a firearm rail, comprising:

an adapter adapted to be temporarily secured to the firearm rail, the adapter including:

a proximal end and a distal end with a hollow body extending therebetween, the hollow body having a central longitudinal axis parallel to an extent of a barrel of the firearm;

a protrusion, the protrusion extending in a radial direction towards the firearm rail and adapted to engage a slot on the firearm rail when the adapter is secured to the firearm and thereby prevent movement of the adapter with respect to the firearm rail in a longitudinal direction;

the suppressor having a projectile aperture at a distal end, the suppressor integrated with or attachable to the distal end of the adapter;

an alignment guide concentrically aligned with the adapter and in mechanical communication with at least one of the adapter or suppressor, the alignment guide having a central bore hole sized to permit passage of a projectile, but prevent passage of a pre-existing muzzle device secured to the firearm;

a gas containment sleeve attachable to or integrated with the alignment guide, the gas containment sleeve sized to reside within the pre-existing muzzle device or ensleeve the pre-existing muzzle device, the gas containment sleeve being gas impermeable to prevent discharged gasses from laterally escaping through the pre-existing muzzle device;

whereby the suppressor can be secured to the firearm by attaching the adapter to the firearm rail without having to remove the pre-existing muzzle device secured to the firearm.

* * * * *